US007878872B2

(12) United States Patent
Strobel

(10) Patent No.: US 7,878,872 B2
(45) Date of Patent: Feb. 1, 2011

(54) STEERING CONNECTION SYSTEM FOR CONNECTING TWO OR MORE MARINE PROPULSION DEVICES

(76) Inventor: Wesley M. Strobel, 2148 Main St., Philomath, OR (US) 97370

( * ) Notice: Subject to any disclaimer, the term of this patent is extended or adjusted under 35 U.S.C. 154(b) by 0 days.

(21) Appl. No.: 11/999,468

(22) Filed: Dec. 4, 2007

(65) Prior Publication Data

US 2009/0142974 A1 Jun. 4, 2009

(51) Int. Cl.
*B63H 5/125* (2006.01)

(52) U.S. Cl. ..... 440/63

(58) Field of Classification Search ..... 440/53, 440/63; 248/640–643
See application file for complete search history.

(56) References Cited

U.S. PATENT DOCUMENTS 3,756,186 A 9/1973 Nordling
3,968,768 A * 7/1976 Solt ..... 440/62
4,573,930 A 3/1986 Queen
6,224,438 B1 5/2001 Hase
6,913,497 B1 7/2005 Ahlswede et al.
7,128,626 B2 10/2006 Dudra et al.
7,207,854 B1 4/2007 Anderson, Jr. et al.

* cited by examiner

*Primary Examiner*—Ed Swinehart
(74) *Attorney, Agent, or Firm*—Teri G. Andrews

(57) ABSTRACT

A steering connecting device for a boat couples the steering of a primary propulsion device and an auxiliary propulsion device. The primary propulsion device has an outer surface and is attached to the transom of the boat and an auxiliary propulsion device. There is a hinge assembly hingeably attached to and essentially parallel to the transom of the boat. There is a mounting plate fixedly attached to the hinge assembly. A tie rod is rotatably attached at a first end to the outer surface of the primary propulsion device and rotatably attached at a second end to the mounting plate. The auxiliary propulsion device is rigidly attached to the mounting plate. As the primary propulsion device is rotated from left to right during steering of the boat, the mounting plate also rotates from left to right thereby rotating the auxiliary propulsion device in unison with the primary propulsion device.

10 Claims, 3 Drawing Sheets

STEERING CONNECTION SYSTEM FOR CONNECTING TWO OR MORE MARINE PROPULSION DEVICES

FIELD OF THE INVENTION

The present invention is generally related to a connection device for use in a marine propulsion system and, more particularly, to a connecting device for connecting two or more outboard motors or stern drive devices.

BACKGROUND OF THE INVENTION

There are currently many different devices and methods in which an outboard motor or stern drive device can be linked to other components, such as other outboard motors or other devices. This added motor or other device typically provides added or an independent motive force while utilizing the primary steering mechanism of the primary device.

All of the currently available devices and systems, however, require the coupling to be directly from one motor or propulsion device to the other.

In one common application, two outboard motors are linked together with a tie bar so they can be rotated about their respective steering axes in a coordinated or tandem manner while combining their power to drive a marine vessel. Often in this type of system, it is desirable or necessary to run just one of the two outboard motors. For example, if one of the motors is malfunctioning, one may want to remove it from service. One problem with this system, however, is that when one of the coupled motors is trimmed upward, or removed from service, it is generally necessary to manually remove or change the configuration of the tie bar arrangement so that the outboard motor remaining in use is able to freely turn about its steering axis without being adversely affected by the other out of service motor. Often the mechanical attachment between the two motors must be removed to raise or completely remove the second or auxiliary motor. With the current tandem steering/drive systems, this is not a simple task.

There is a need for a steering connection device for coupling two or more marine propulsion devices that allows a single steering system to steer multiple motors on a marine vessel that is easily installed, essentially universal for most applications, allows for the connection device to remain installed while removing the auxiliary motor, allows the auxiliary motor to be lifted out of service without removing the connection device, and is simplistic in design for low cost manufacturing.

SUMMARY OF THE INVENTION

The present invention advantageously provides a steering connecting device for a boat that couples the steering of a primary propulsion device and an auxiliary propulsion device. The primary propulsion device has an outer surface and is attached to the transom of the boat. There is a hinge assembly hingeably attached to and essentially parallel to the transom of the boat. There is a mounting plate attached to the hinge assembly. A tie rod is rotatably attached at a first end to the outer surface of the primary propulsion device and rotatably attached at a second end to the mounting plate. The auxiliary propulsion device is rigidly attached to the mounting plate. As the primary propulsion device is rotated from left to right during steering of the boat, the mounting plate also rotates from left to right thereby rotating the auxiliary propulsion device in unison with the primary propulsion device.

It is a primary objective of the present invention to provide a steering connection device for two or more marine propulsion devices that allows multiple devices to be steered with a single steering system without physically attaching the two motors thereby allowing removal or lifting of any one or all of the auxiliary motors without requiring any adjustment or removal of the connection system.

It is another object of the present invention to provide a new steering connection device for multiple marine propulsion devices which may be easily and efficiently manufactured and marketed.

It is a further object of the present invention to provide a new steering device for multiple marine propulsion devices which is of a simple yet durable and reliable construction.

An even further object of the present invention is to provide a steering device which is designed for low cost manufacturing with regard to both materials and labor, thereby allowing the steering device to be economically available to the consumer.

It is yet another object of the present invention to provide a steering device for multiple marine propulsion devices which will allow uninhibited steering of the primary motor even when one drive device is tilted into a stored, non-operational position.

It is yet another object of the present invention to provide a steering device for multiple marine propulsion devices that is easily retrofittable to upgrade current or obsolete steering systems.

BRIEF DESCRIPTION OF THE DRAWINGS

The above description and other objects, advantages, and features of the present invention will be more fully understood and appreciated by reference to the specification and accompanying drawings, wherein.

DRAWING ELEMENT NUMBERS

| | |
|---|---|
| 102 | Boat |
| 104 | Primary Motor |
| 106 | Secondary Motor |
| 110 | Tie Rod |
| 112 | Primary Attach Point |
| 114 | Secondary Attach Point |
| 202 | Clamps |
| 204 | Clamp Screw |
| 206 | Motor Mount Bracket |
| 208 | Motor Mount Pivot Bolts |
| 210 | Mount Attach Bracket |
| 212 | Hinge Assembly |
| 214 | Hinge Assembly Attach Bolts |
| 216 | Tie Rod Attach Bar |
| 218 | Rotational Axis Supports |
| 302 | Hinge Assembly Attach Plate |
| 304 | Mount Plate Bolts |
| 306 | Mount Plate Nuts |
| 308 | Hinge Assembly Attach Nuts |
| 310 | Rotational Axis Pin |
| 312 | Rotational Axis Sleeve |

DETAILED DISCUSSION OF THE PREFERRED EMBODIMENTS

Referring to the figures, like elements retain their element numbers throughout the several views.

Figure 1:
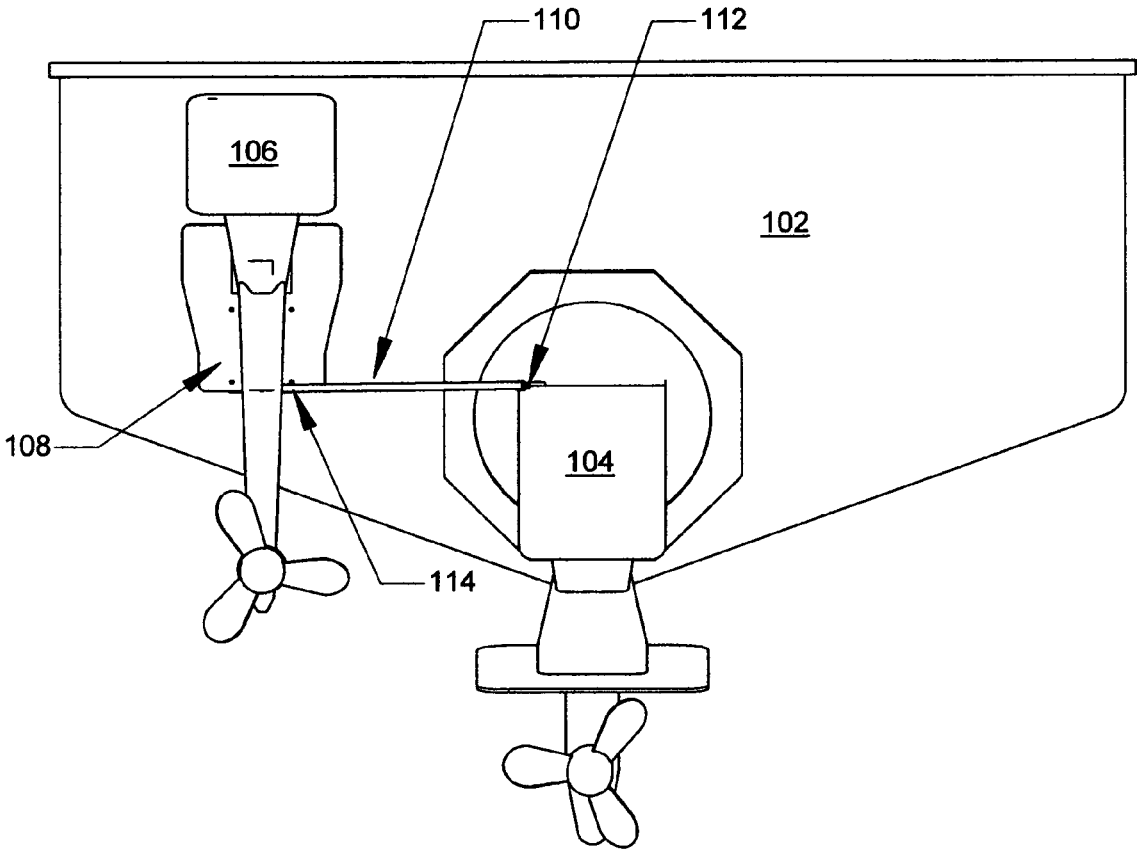
FIG. 1 is a prospective view of the steering connection device of the present invention installed between an outdrive motor and a smaller trolling motor.

FIG. 1 is a prospective view of the steering connection device of the present invention installed between Primary Motor 104 and Secondary Motor 106. Although in the preferred embodiment Primary Motor 104 is a stern drive motor and Secondary Motor 106 is a small outboard motor, it has been contemplated that other suitable propulsion devices include, but are not limited to, large outboard motors, jet drive motors, or even steering rudders like those found on sailboats.

Boat 102 is shown with Primary Motor 104 located essentially in the center, lower portion of the rear of Boat 102. Secondary Motor 106 is attached to Motor Mounting Plate 108 that is attached to the transom of Boat 102 with a typical fixed or adjustable mounting assembly (not shown).

Tie Rod 110 is a common device with ball joints on either end with a hole through them for extending a bolt through for connection purposes. Tie Rod 110 is rotatably attached to Primary Motor 104 at Primary Attach Point 112. In the preferred embodiment, Primary Attach Point 112 is simply a bolt extending through one end of Tie Rod 110 and into a preexisting bolt hole (not shown) in Primary Motor 104. Secondary Attach Point 114 is rotatably attached to Motor Mount Bracket 206 (not shown) and will be discussed in detail in the FIG. 2 discussion. In the case of an outboard primary motor, one end of Tie Rod 110 can be rotatably bolted to an installed mounting plate on the primary motor. Ease of alignment and the versatility of the present invention allows for many alternative mounting points that may be available on varying styles, brands, and vintages of marine propulsion devices.

Figure 2:
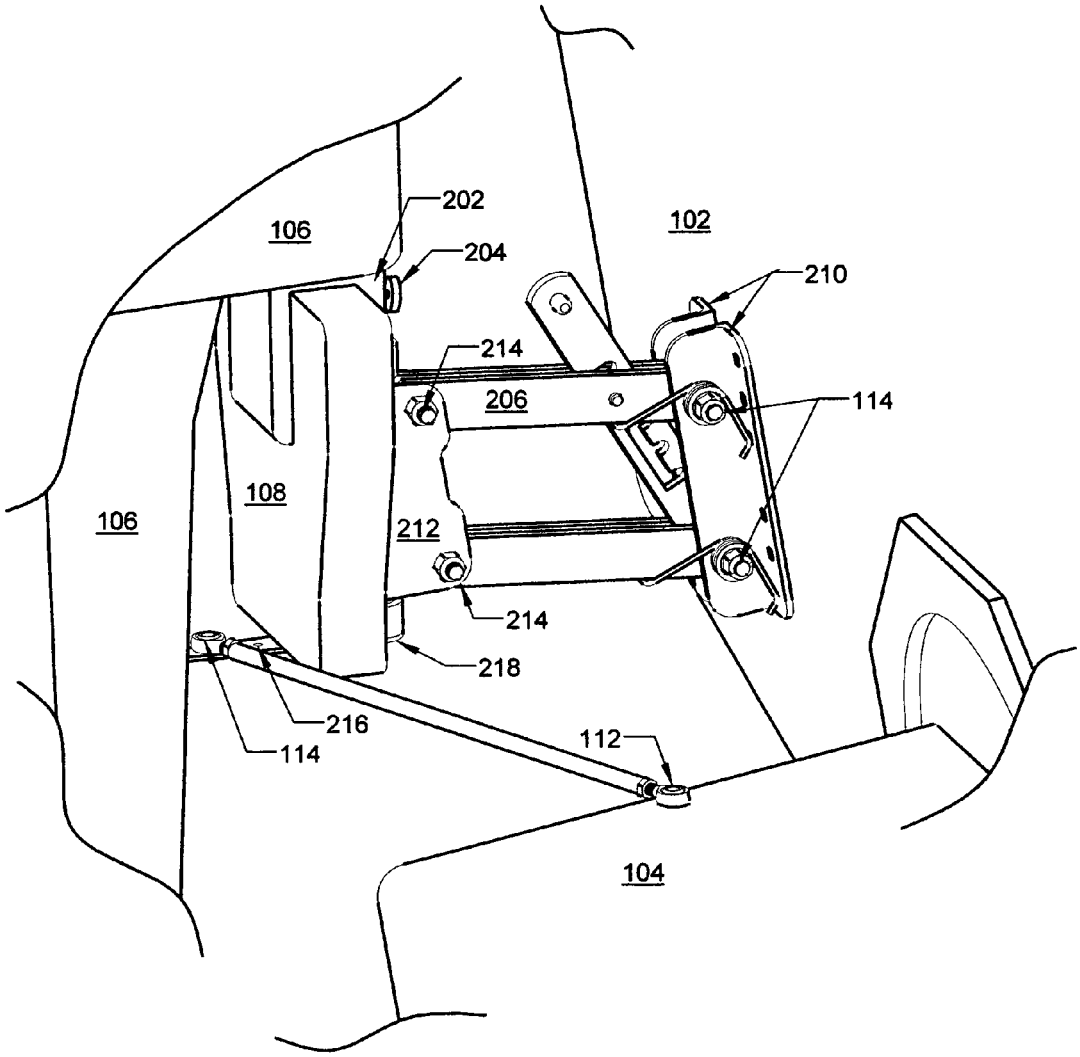
FIG. 2 is a side, isometric view of the present invention.

FIG. 2 is a side, isometric view of the preferred embodiment of the steering connection device of the present invention. As previously discussed, Tie Rod 110 is attached to Primary Motor 104 at Primary Attach Point 112 at a first end and at Secondary Attach Point 114 at the opposing end. Secondary Attach Point 114 is rotatably attached to Tie Rod Attach Bar 216 that extends from the lower Rotational Axis Support 218. To accommodate differing equipment and architectures, Tie Rod Attach Bar 216 has multiple mounting holes—the user selecting the one appropriate for their application.

In the preferred embodiment of the present invention, Secondary Motor 106 is locked into the stationary, or non-rotational, centered position. Secondary Motor 106 is now rotated according to the movement translated from Tie Rod 110 onto Motor Mounting Plate 108 that is rotatably attached to the rotatable steering connection device of the present invention.

Secondary Motor 106 is attached to Motor Mounting Plate 108 with Clamp 202 that is secured in place by Clamp Screws 204. Hinge Assembly 212 is attached to Motor Mount Bracket 206 by Hinge Assembly Attach Bolts 214. Motor Mount Bracket 206 is attached to Mount Attach Bracket 210 that is fixedly attached to the rear or transom portion of Boat 102.

A common prior art single motor mounting assembly includes a motor mounting plate similar to Motor Mounting Plate 108 that remains essentially parallel to the rear of Boat 102 and is fixedly attached to some type of motor mount bracket similar to Motor Mount Bracket 206. In this typical situation, Secondary Motor 106 rotates on its own axis either by the operator rotating the motor from side to side with an attached tiller, or in the event there is a tandem steering device installed, by the steering of the directly attached primary motor.

To utilize the present invention, the aforementioned single motor mounting assembly is easily adapted to the configuration of the present invention. Motor Mount Bracket 206 need only be detached from Motor Mounting Plate 108 and Hinge Assembly 212 and its subcomponents (discussed in detailed in the FIG. 3 discussion) inserted between Motor Mounting Bracket 206 and Motor Mounting Plate 108. The present invention, once installed between an existing secondary motor mounting system and a primary propulsion device on a boat is completely independent of the type, size or architecture of the secondary motor mounted on Motor Mounting Plate 108.

The steering connection device of the present invention allows Secondary Motor 106 to be removed, replaced, or lifted out of the water without a need to remove the steering connection device from either the secondary motor mounting system or Primary Motor 104.

Figure 3:
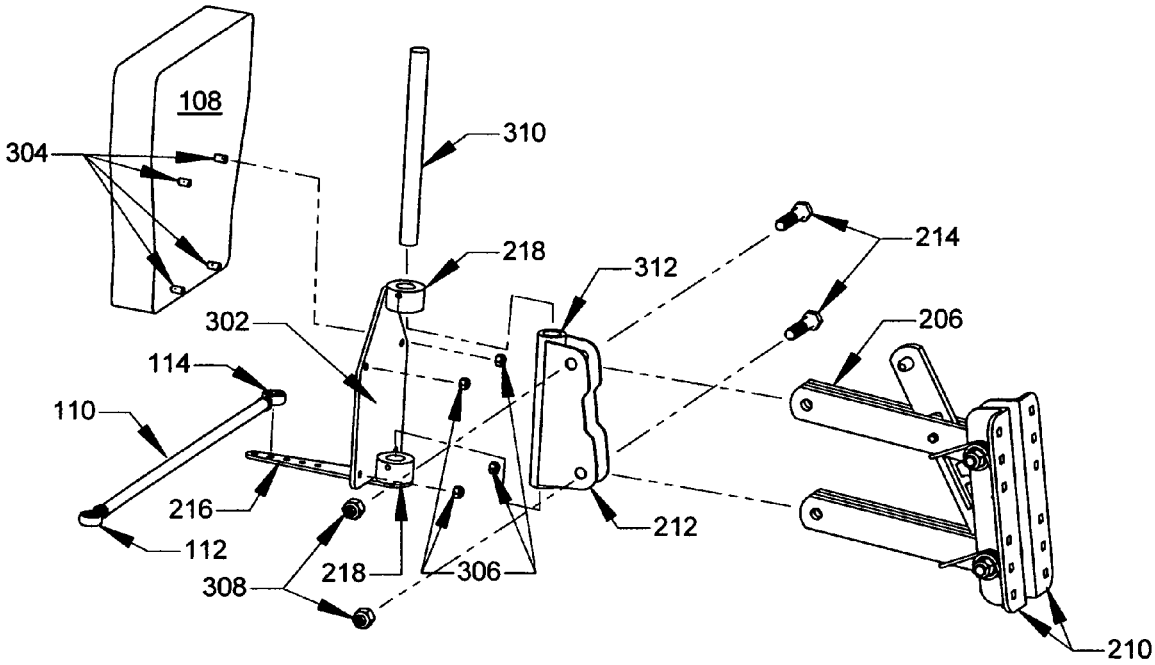
FIG. 3 is an exploded view of the steering connection assembly of the present invention.

FIG. 3 is an exploded view of the preferred embodiment of the steering connection device of the present invention. Hinge Assembly 210 fixedly attaches to the rear or transom of a power boat (not shown). Motor Mount Bracket 206 is hingably attached to Mount Attach Bracket 210 for raising and lowering a secondary motor. The opposite end of Motor Mount Bracket 206 is inserted into Hinge Assembly 212 and held in place with Hinge Assembly Attach Bolts 214 that extend through a first side of Hinge Assembly 212, Motor Mount Bracket 206, and then secured in place with Hinge Assembly Attach Nuts 306. Rotational Axis Sleeve 312 is slipped between Rotational Axis Supports 218 and held in rotatable attachment by Rotational Axis Pin 310 inserted through the upper Rotational Axis Support 218, through Rotational Axis Sleeve 313, and then lodged in the lower Rotational Axis Support 218.

Rotational Axis Supports 218 are fixedly attached to an upper and a lower edge of Hinge Assembly Attach Plate 302. Hinge Assembly Attach Plate 302 attaches to Motor Mounting Plate 108 by sliding over Mount Plate Bolts 304 and secured in place with Mounting Plate Nuts 306. Tie Rod Attach Bar 216 is fixedly attached to the lower edge of Rotational Axis Supports 218 and in the preferred embodiment has a series of holes disposed along its length for varied attachment of Secondary Attach Point 114 of Tie Rod 110.

In an alternate embodiment, a tertiary motor is mounted to the other side of Primary Motor 104 from Secondary Motor 106 with a similar steering connection device as discussed in the preferred embodiment of the present invention. Tie Rod 110 for the tertiary motor would be attached to the opposite of Primary Motor 104 from Secondary Motor 106. In this configuration, the single primary steering system of Boat 102 would steer all three motors in unison.

In the preferred embodiment of the present invention, all components are manufactured from stainless steel. Alternative materials include, but are not limited to carbon steel, titanium, scandium alloys, aluminum, injected molded poly carbonate, high density plastics, or any other rigid, strong material that will sustain the weight of a marine propulsion device. In some instances, a combination of the aforementioned materials may be used.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

The invention claimed is:

1. A steering connecting device for a boat for coupling the steering of a primary propulsion device having an outer surface and attached to a transom of the boat and an auxiliary propulsion device, comprising:

a vertical hinge assembly essentially parallel to and hingeably attached to the transom of the boat at a first hinge side;

a mounting plate fixedly attached to said hinge assembly at a second hinge side opposite said first hinge side; and a tie rod attached at a first end to the outer surface of the primary propulsion device and attached at a second end to said mounting plate;

wherein, the auxiliary propulsion device is rigidly attached to said mounting plate and as the primary propulsion device is rotated from left to right during steering of the boat, said mounting plate also rotates from left to right thereby rotating and steering the auxiliary propulsion device essentially in unison with the primary propulsion device.

2. The steering connecting device of claim 1, wherein said tie rod has an adjustable length.

3. The steering connecting device of claim 1, wherein said first end and said second end of said tie rod each have a ball joint attached at their extremities for rotatable connection to the outer surface of the primary propulsion device and said mounting plate.

4. The steering connecting device of claim 1, further comprising:

a motor mount bracket attached on a first bracket side to the transom of the boat and on a second bracket side to the hinge assembly, wherein said motor mount bracket facilitates the raising and lowering of the auxiliary propulsion device between an in the water position and an out of the water position.

5. The steering connecting device of claim 1, wherein said first end and said second end of said tie rod each have a nut attached at their extremities for rotatable connection to a bolt fixedly attached to the outer surface of the primary propulsion device and said mounting plate.

6. The steering connecting device of claim 1, wherein the hinge assembly is made of stainless steel.

7. The steering connecting device of claim 1, wherein the hinge assembly is made of carbon steel.

8. The steering connecting device of claim 1, wherein the hinge assembly is made of aluminum.

9. The steering connecting device of claim 1, wherein the hinge assembly is made of titanium.

10. The steering connecting device of claim 1, wherein the hinge assembly is made of a material from the group consisting of: stainless steel, carbon steel, aluminum, titanium, scandium alloys, high density plastics, or poly carbonate.

* * * * *